US006993879B1

(12) United States Patent
Cantley

(10) Patent No.: US 6,993,879 B1
(45) Date of Patent: Feb. 7, 2006

(54) MOLDED PLASTIC TRUSS WORK

(76) Inventor: Richard W. Cantley, 4703 Bentley, Troy, MI (US) 48098

( * ) Notice: Subject to any disclaimer, the term of this patent is extended or adjusted under 35 U.S.C. 154(b) by 218 days.

(21) Appl. No.: 10/272,687

(22) Filed: Oct. 17, 2002

Related U.S. Application Data

(60) Provisional application No. 60/346,195, filed on Oct. 19, 2001.

(51) Int. Cl.
*E04C 3/02* (2006.01)
*E04C 3/28* (2006.01)

(52) U.S. Cl. ..... 52/652.1; 52/653.2; 52/690; 52/693; 52/633; 446/124

(58) Field of Classification Search ..... 52/652.1, 52/653.1, 653.2, 649.1, 690, 693, 2.18, 2.21, 52/633; 446/476, 105, 124, 126
See application file for complete search history.

(56) References Cited

U.S. PATENT DOCUMENTS

| | | | | | |
|---|---|---|---|---|---|
| 1,349,868 | A | * | 8/1920 | Atterbury | 52/381 |
| 1,613,788 | A | * | 1/1927 | Frease et al. | 52/652.1 |
| 3,277,479 | A | * | 10/1966 | Struble, Jr. | 342/8 |
| 3,415,027 | A | * | 12/1968 | Bradley et al. | 53/263 |
| 3,830,011 | A | * | 8/1974 | Ochrymowich | 446/126 |
| 3,927,489 | A | * | 12/1975 | Bernstein | 446/104 |
| 3,969,864 | A | * | 7/1976 | Stephenson et al. | 52/475.1 |
| 4,180,232 | A | | 12/1979 | Hardigg | 249/60 |
| 4,302,900 | A | * | 12/1981 | Rayner | 446/120 |
| 4,419,321 | A | | 12/1983 | Hardigg | 264/328.12 |
| 4,580,680 | A | | 4/1986 | Wind | 206/386 |
| 4,701,131 | A | * | 10/1987 | Hildebrandt et al. | 434/211 |
| 4,757,665 | A | | 7/1988 | Hardigg | 52/782 |
| 4,772,175 | A | * | 9/1988 | Grimaldi | 414/689 |
| 4,829,739 | A | * | 5/1989 | Coppa | 52/745.2 |
| 5,008,967 | A | * | 4/1991 | Barrios et al. | 14/7 |
| 5,145,075 | A | * | 9/1992 | Johnson et al. | 212/347 |
| 5,315,806 | A | * | 5/1994 | Da Casta Trias de Bes | 52/81.1 |
| 5,318,470 | A | * | 6/1994 | Denny | 446/126 |
| 5,505,035 | A | * | 4/1996 | Lalvani | 52/648.1 |
| 6,076,324 | A | * | 6/2000 | Daily et al. | 52/648.1 |
| 6,079,178 | A | * | 6/2000 | Fisher | 52/690 |
| 6,170,560 | B1 | * | 1/2001 | Daily et al. | 164/516 |
| 6,604,710 | B2 | * | 8/2003 | Ohmer et al. | 244/119 |
| 6,607,331 | B2 | * | 8/2003 | Sanders et al. | 405/196 |
| 6,761,124 | B1 | * | 7/2004 | Srinivasan | 114/264 |

FOREIGN PATENT DOCUMENTS

| | | | | |
|---|---|---|---|---|
| GB | 2011507 | * | 11/1978 | 52/693 |
| GB | 2251872 | * | 7/1992 | 52/652.1 |
| JP | 2473 | * | 1/1991 | 52/652.1 |

* cited by examiner

*Primary Examiner*—Phi Dieu Tran A
(74) *Attorney, Agent, or Firm*—Gifford, Krass, Groh, Sprinkle, Anderson & Citkowski, PC

(57) ABSTRACT

A molded plastic truss work includes an upper grid and a lower grid, with a plurality of interconnecting members interconnecting the grids. The upper grid includes longitudinal members and transverse members that extend between and interconnect the longitudinal members. The lower grid includes longitudinal members and transverse members extending between and interconnecting the longitudinal members. The longitudinal members in the lower grid are positioned such that each of the longitudinal members in the lower grid is not directly below any of the longitudinal members in the upper grid. The transverse members in the lower grid are positioned such that each of the transverse members in the lower grid is not directly below any of the transverse members in the upper grid. The plurality of interconnecting members extend between the upper and lower grids, and include a plurality of vertical members.

10 Claims, 3 Drawing Sheets

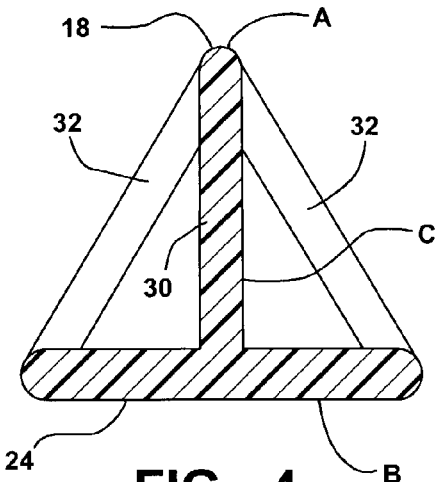
FIG - 4
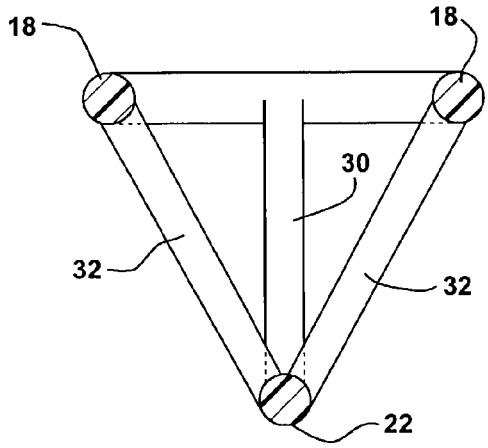
FIG - 5
FIG - 6
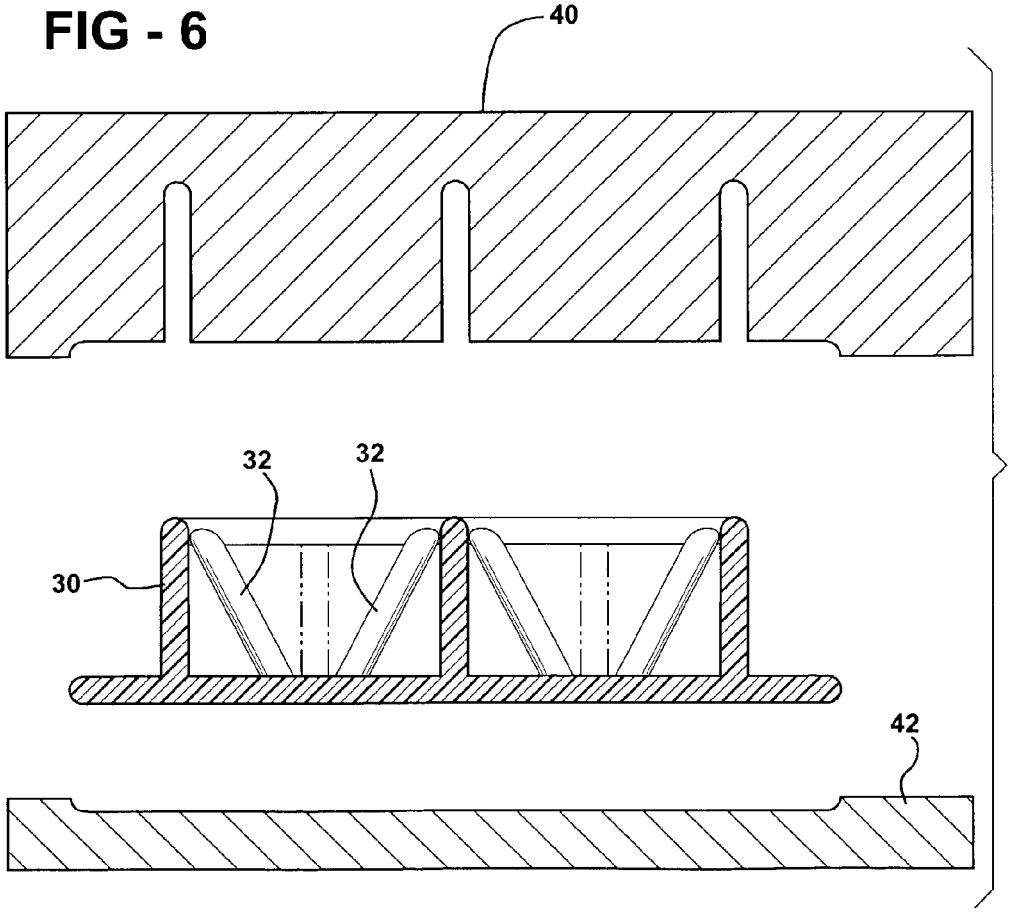

MOLDED PLASTIC TRUSS WORK

This application claims the benefit of Provisional Application No. 60/346,195, filed Oct. 19, 2001.

FIELD OF THE INVENTION

The present invention relates generally to structural panels and truss work and, more specifically, to a plastic truss work designed to be molded using a two-part mold.

BACKGROUND OF THE INVENTION

Plastic molding offers numerous benefits in the production of simple products. Many plastic molded products have high functionality and quality, and a low cost to manufacture. In addition, plastic molding allows high volume production of essentially identical products with consistent quality. This is especially true with products having simple geometric configurations, allowing the use of a two-part mold. In a typical two-part mold, the mold has two halves that join together to define a void, with the void having the same shape as the product to be molded. During molding, the void is filled with plastic to form the product. The mold halves then separate linearly from one another to remove the part from the mold. The complexity of the part molded in a two-part mold is obviously limited by the fact that the mold splits into two halves that move linearly with respect to each other. More complexly shaped products require molds with additional movable portions, or with additional sections that split apart or move relative to one another. This significantly increases the cost and complexity of the mold, and consequently increases the cost of the product molded. Therefore, it is strongly preferred that plastic molded products be designed such that a simple mold may be used. It is especially preferred that a two-part mold be used to form the part.

A number of traditionally non-plastic products have been successfully replicated in plastic. Examples include plastic deck boards, fence posts, latticework, porch columns and railings. Plastics have not been successfully used to form large structural or truss work panels. This is partially due to the complexity and size of such a product, and also to the need to minimize the use of plastic. The cost of plastic products is typically directly proportional to the volume of plastic used to form the part. Therefore, cost minimization requires minimization of plastic.

Truss work panels have wide applicability, including use as structural reinforcement members in wall panels and building materials. However, typical truss work panels have a complicated design that make it impossible to integrally form the truss work. Instead, the truss work is typically assembled from a multiple of pieces, which is time and labor intensive. U.S. Pat. No. 6,076,324 to Daily et al. shows a truss structure design that is integrally formed using stereolithography or other rapid prototyping techniques to integrally form the three-dimensional truss structures or to create disposable molds. While offering some benefits, the Daily design remains complicated to manufacture, and would be impossible to form using traditional two-part injection molding.

U.S. Pat. Nos. 4,180,232; 4,419,321; and 4,757,665, each to Hardigg, disclose a truss panel that can be molded using traditional two-part molds. However, the Hardigg design lacks any members that extend directly perpendicularly between members in an upper and lower set. This compromises the ability of the truss work to withstand structural loads.

SUMMARY OF THE INVENTION

The present invention improves on the prior art by providing a three-dimensional truss work that may be injection molded from plastic in a traditional two-part mold. The truss work may be molded in panels or strips of any size, and has utility in a wide variety of applications. The molded plastic truss work according to one embodiment of the present invention includes an upper grid that is disposed generally in a first plane. The upper grid has a plurality of spaced-apart generally parallel longitudinal members and a plurality of spaced-apart generally parallel transverse members that extend between and interconnect the longitudinal members. The truss work also has a lower grid that is disposed generally in a second plane spaced from and generally parallel to the first plane. The second grid has a plurality of spaced-apart generally parallel longitudinal members and a plurality of spaced-apart generally parallel transverse members extending between and interconnecting the longitudinal members. The longitudinal members in the lower grid are positioned such that each of the longitudinal members in the lower grid are not directly below any of the longitudinal members in the upper grid. The transverse members in the lower grid are positioned such that each of the transverse members in the lower grid are not directly below any of the transverse members in the upper grid. A plurality of interconnecting members extend between the upper and lower grids. These include a plurality of vertical members, with one vertical member being provided at each point that a longitudinal member and the upper grid passes above a transverse member in the lower grid, and each point that a transverse member in the upper grid passes above a longitudinal member in the lower grid.

BRIEF DESCRIPTION OF THE DRAWINGS

FIG. 4 is a cross-sectional view of the truss work of FIG. 2, taken along lines 4—4;

FIG. 5 is a cross-sectional view of the truss work of FIG. 2, taken along lines 5—5; and FIG. 6 is a cross-sectional side view of a portion of a mold used to form a truss work according to one embodiment of the present invention.

DETAILED DESCRIPTION OF THE PREFERRED EMBODIMENTS

Figure 1:
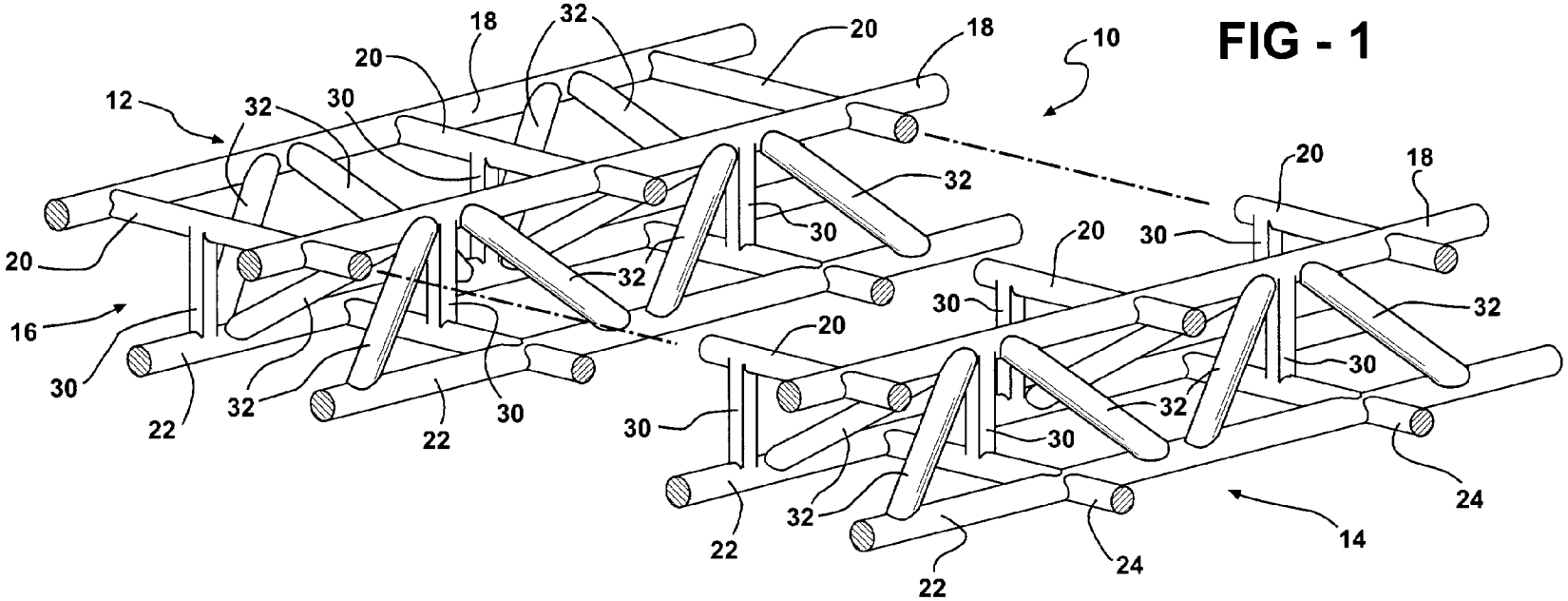
FIG. 1 is an exploded perspective view of a portion of a plastic truss work according to a first embodiment of the present invention.
Figure 3:
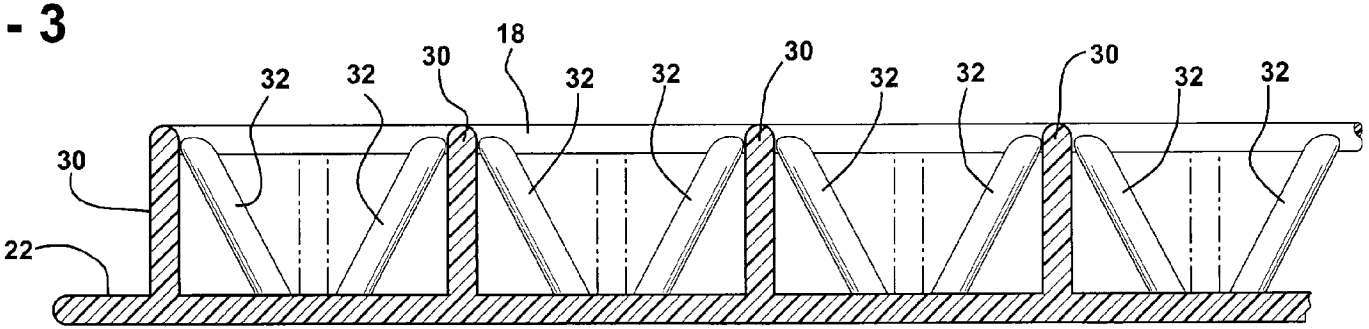
FIG. 3 is a cross-sectional end view of the truss work of FIG. 2 taken along lines 3—3.

Referring to FIG. 1, a portion of a plastic truss work according to the present invention is generally shown at 10. The truss work includes a generally planar upper grid 12, a generally planar and parallel lower grid 14, and a plurality of interconnecting members 16. The lower grid 14 is spaced below the upper grid 12 by a short distance. The upper grid 12 includes a plurality of generally parallel longitudinal members 18 that are spaced apart at intervals. The upper grid also includes a plurality of generally parallel transverse members 20 that extend between and interconnect the longitudinal members 18. The transverse members 20 are preferably spaced apart at equal intervals. It should be noted that the terms such as "upper", "lower", "longitudinal", and "transverse" are used for ease of description. However, these terms do not limit the present invention to particular positions of use or orientations. For example, the truss work 10 may be inverted such that the upper grid is actually below the lower grid, or may be positioned in other positions. Terms such as "longitudinal", as used herein, define a consistent orientation, but do not necessarily require the longitudinal members be in the long direction. Likewise, "transverse" defines a consistent orientation with respect to particular embodiments, but does not require that transverse members be side-to-side in orientation. That is, members defined as longitudinal when describing a particular embodiment are all generally parallel to one another, and transverse members are also mutually generally parallel. Also, transverse members and longitudinal members are not necessarily at right angles to one another, though they would typically be at right angles to one another in a preferred embodiment. With respect to discussions with respect to molding of the grid work, it is assumed that molding would be done such that there is an upper mold half and a lower mold half, with the terms upper and lower referring to the same orientations used with respect to describing the truss work 10.

Both the longitudinal 18 and transverse 20 members are shown cut off at their ends to indicate that the truss work 10 may extend to any reasonable length and width as necessary to form a particular product. In the illustrated embodiment, the lower grid 14 is similar to the upper grid in that it includes a plurality of spaced apart generally parallel longitudinal members 22 and a plurality of transverse members 24 that are generally parallel and spaced apart, and extend between the longitudinal members 22 so as to interconnect longitudinal members 22. In the illustrated embodiment, the longitudinal members 18 and 22 are generally perpendicular to the transverse members 20 and 24. In FIG. 1, the longitudinal members 18 appear to be continuous members, while the transverse members 20 appear to be discontinuous, and just to extend between the longitudinal members. However, as the truss 10 is injection molded as one integral piece, both the longitudinal 18 and transverse 20 members may be considered to be continuous. Alternatively, they could be described as being elongated transverse members 20 with the longitudinal members 18 extending between and interconnecting the transverse members 20.

Figure 2:
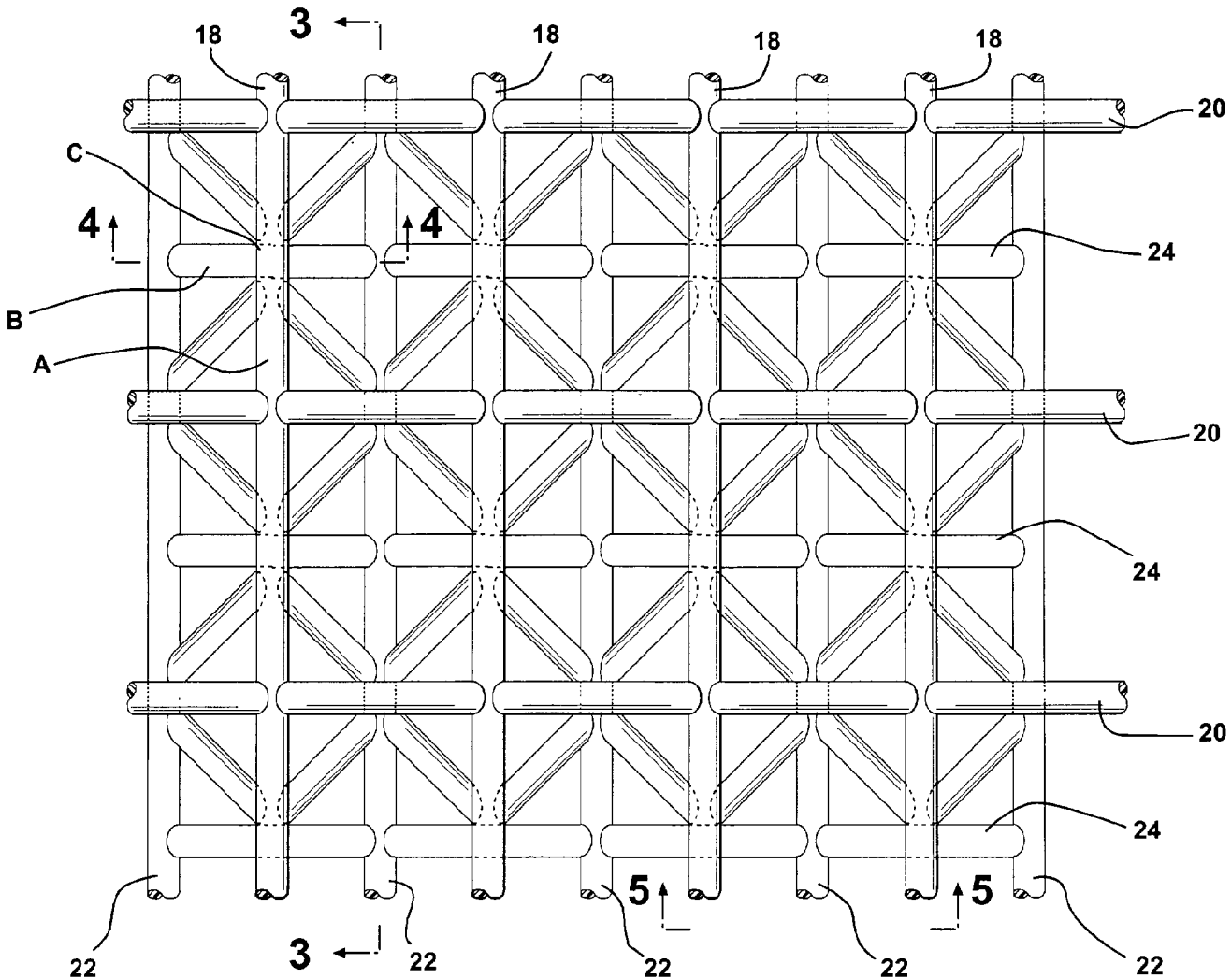
FIG. 2 is a top plan view of the truss work of FIG. 1.

As best seen in FIG. 2, the longitudinal members 18 in the upper grid 12 are offset with respect to the longitudinal members 22 in the lower grid 14. Likewise, the transverse members 20 in the upper grid 12 are offset with respect to the transverse members 24 in the lower grid 14. Consequently, no transverse member 20 in the upper grid 12 is directly above a transverse member 24 in the lower grid 14. The same is true with longitudinal members 18 and 22. As will be clear to those of skill in the art, this offsetting of the longitudinal and transverse members in the upper grid relative to those in the lower grid allows for easier molding. For example, if a longitudinal member 18 in the upper grid 12 were directly above a longitudinal member 22 in the lower grid, a two-part mold could not be used unless the area between the upper and lower grid members were to be filled entirely with plastic. This would substantially increase the amount of plastic used to form the truss work. Looked at another way, a two-piece mold must be designed such that there are no "hidden" areas. The part to be molded may be analyzed as if looking at the part from the perspective from each of the mold halves. If a particular surface or area cannot be "seen" from the perspective of one of the two mold halves, a two-piece mold will not work. In the present example, if a longitudinal member in the upper grid were directly above a longitudinal member in the lower grid, the space above the lower longitudinal member and below the upper longitudinal member could not be "seen" by a mold half that is above or below the truss work. The embodiment of FIGS. 1 and 2 avoids this problem. The upper surface of each of the longitudinal members 22 in the lower grid 14 may be "seen" by an upper mold half, while the lower surfaces of each of the longitudinal members 18 in the upper grid 12 may be "seen" by a lower mold half.

In the illustrated embodiment, the longitudinal members in the upper grid are approximately half way between the longitudinal members in the lower grid. The same is true with the transverse members.

The upper grid 12 may be said to lie in a first plane, with the lower grid being said to lay in a second plane that is spaced apart from and generally parallel to the first plane. The upper grid 12 and lower grid 14 are interconnected by interconnecting members 16. The interconnecting members 16 include generally vertical members 30 and angle members 32. The vertical members 30 preferably are orthogonal to both the planes of the upper and lower grids 12 and 14. Preferably, vertical members are provided anywhere a longitudinal member 18 or transverse member 20 in the upper grid 12 crosses directly above a transverse member 24 or a longitudinal member 22 in the lower grid 14, respectively. Referring to FIG. 2, one of the longitudinal members 18 in the upper grid 12 is indicated as A. One of the transverse members 24 in the lower grid 14 is indicated as B. Where the longitudinal member A passes above the transverse member B, a vertical member C is provided. This may also be seen in FIG. 4, which is a cross-section of this portion of the truss work.

As best shown in FIGS. 1 and 2, the vertical members 30 each have a generally rectangular or square cross-section. As will be clear to those of skill in the art, this cross-sectional shape is due to the goal of molding the truss work with the two-part mold. Referring to FIG. 2, the vertical member C is "under" the longitudinal member A and it is "above" the transverse member B. The total blocked area that cannot be "seen" by either mold half ends up being a square cross-section column. Therefore this column must be at least this size to be molded in the two-part mold. That is, the column C must have a transverse dimension at least equal to the width of the longitudinal member A and a longitudinal dimension at least equal to the width of the transverse member B. The column C could of course have a larger dimension that these minimums.

The provision of the vertical members 30 at each of the intersection points allows the use of a two-piece mold. As shown in FIG. 6, a two-part mold has an upper portion 40 and a lower portion 42. The angled members 32 also extend between the upper and lower grids. The angle members are positioned such that they can also be molded in a two-part mold, along with the entire truss work. Preferably, the angled members 32 are positioned and arranged such that they are not above or below longitudinal or transverse members in the upper or lower grid. The angled members 32 join the longitudinal and transverse members in the upper and lower grid such that the ends of the angled members are slightly offset from the point where the vertical members 30 join. This allows the mold halves "clear views" of the upper and lower surfaces of the angled members. FIG. 2 shows some of the angled members being slightly too close to the intersection point between the vertical columns and the longitudinal members 22 in the lower grid. The proper positioning is shown where the upper ends of the angled members join the upper longitudinal members 22. This is the preferred positioning for both ends of the angled members, since a "clear view" is provided to the mold halves. In an alternative embodiment, the angled members 32 may join the longitudinal transverse members at approximately the same point that the vertical members 30 do. However, this causes the vertical members 30 to have an odd cross-sectional shape, and complicates the mold. That is, if the angled members 32 join the longitudinal and transverse members at approximately the same junction point as the vertical members 30, a larger area between the longitudinal and transverse members in the upper and lower grid is blocked from the "view" of the mold halves, causing the vertical members to be somewhat larger.

In the Figures included herewith, the truss work according to the present invention is illustrated as having generally longitudinal and transverse members in each of an upper and lower plane. As will be clear to those of skill in the art, the design of the truss work may be altered such that the members in the upper and/or lower plane run at different angles, are spaced at different intervals, or some of the members may be eliminated entirely. One key to the present invention is that the provision of a vertical interconnecting member anywhere a member in the upper plane crosses "above" a member in the lower plane allows the use of a two-part mold. The diagonal or angled interconnecting members could be eliminated. In fact, the variety of truss work designs using interconnecting members at the cross-over points is almost unlimited. Therefore, it should be understood that any design where these interconnecting members are used to allow the use of a two-part mold falls within the scope and teaching of the present invention. Also, depending on the application of the truss work, gaps or attachment flanges or other modifications may be provided to suit the particular application.

As will be clear to those of skill in the art, truss work according to the present invention is useful in a wide variety of applications. Consequently, various dimensions may prove most suitable depending on the particular application. In one application, the truss work is used as structural components for flooring or decking, with the truss work formed as panels that extend under the decking or flooring. In another application, the truss work is formed as panels, and then covered with fabric or other covering and used as dividers, such as cubicle or wall dividers. In yet another embodiment, the truss work is embedded in a softer material, such as a foam, to give the softer material more rigidity. In this application, the truss work would typically be formed in a first step, and then inserted into a secondary mold where foam or other material is injected around it. In some embodiments, the upper grid and lower grid may be separated by a very small distance, such as one-quarter to one-half inch, while the longitudinal members and transverse members are spaced at intervals of a similar distance. In other embodiments, the separation between the upper and the lower grid, as well as the separation between the parallel and longitudinal members, may be increased substantially such as to several inches or to one foot or more. The relative ratios of dimensions may also be different than illustrated in the preferred embodiments. For example, the relative spacing between longitudinal and transverse members may be maintained as shown, while the separation between the upper and lower grid is substantially decreased or increased. The illustrated embodiments depict the longitudinal members being separated by a similar interval to the transverse members in both the upper and lower grid. However, the spacing between longitudinal members may be substantially different than spacing between transverse members, and the dimensions may also be different between upper and lower grids. This allows the grid to be designed such that it is stronger in a particular direction.

The illustrated preferred embodiment of the present invention illustrates the various longitudinal and transverse members as all being round in cross-section. However, any or all of these members may have other cross-sections, such as square or rectangular, depending upon the application. As will be clear to those of skill in the art, these cross-sections will have to be chosen such that they release from a mold. For example, if a rectangular or square cross-section is used, the sidewalls of the square or rectangular cross-section will require some draft to allow it to release from the mold. The illustrated preferred embodiment also illustrates each of the members having an approximately equal cross-sectional area. However, any or all of the transverse or longitudinal or interconnecting members may be changed in relative dimension. For example, the interconnecting members may have some smaller or larger cross-sectional areas than the members in the upper or lower grid. The dimensions of the longitudinal members may be different than the transverse members, or any other variations. Also, the angled members 32 may be partially or completely eliminated, or placed at different angles than illustrated. In the illustrated embodiments, the angled members run at approximately 45 degrees between the upper and lower grids, but they may run at other angles. Throughout this specification, the truss work has been described as a plastic molded product. However, it should be understood that the term plastic should be interpreted broadly. Also, the present invention may be used to "mold" other materials or to form a truss using a mold-like process, such as casting.

As will be clear to those of skill in the art, the preferred embodiments of the present invention may be altered in various ways without departing from the scope or teaching of the present invention. It is the following claims, including all equivalents, which define the scope of the present invention.

I claim:

1. A truss work, comprising:

an upper grid disposed generally in a first plane, the upper grid having a plurality of spaced apart generally parallel longitudinal members and a plurality or spaced apart generally parallel transverse members extending between and interconnecting the longitudinal members:

a lower grid disposed generally in a second plane spaced below and generally parallel to said first plane, the lower grid having a plurality of spaced apart generally parallel longitudinal members and a plurality or spaced apart generally parallel transverse members extending between and interconnecting the longitudinal members, the longitudinal members in the lower grid positioned such that each of the longitudinal members in the lower grid are not directly below any of the longitudinal members in the upper grid, the transverse members in the lower grid positioned such that each of the transverse members in the lower grid are not directly below any of the transverse members in the upper grid; and a plurality of interconnecting members extending between the upper and lower grids including a plurality of vertical members, one vertical member being provided at each point that a longitudinal member in the upper grid passes above a transverse member in the lower grid and at each point that a transverse member in the upper grid passes above a longitudinal member in the lower grid;

wherein the truss work is integrally formed as one piece.

2. The truss work according to claim 1, wherein the longitudinal members in the upper grid are perpendicular to the transverse members in the upper grid and the longitudinal members in the lower grid are perpendicular to the transverse members in the lower grid.

3. The truss work according to claim 1, wherein an intersection volume is defined as the volume that is both perpendicularly below a member in the upper grid and perpendicularly above a member in the lower grid at each point where a longitudinal member in the upper grid passes above a transverse member in the lower grid and at each point where a transverse member in the upper grid passes above a longitudinal member in the lower grid, each of the vertical members having a cross sectional shape that completely fills one of the intersection volumes.

4. The truss work according to claim 1, wherein each or the longitudinal and transverse members has a generally round cross section and each of the vertical interconnecting members has a generally rectangular cross section.

5. The truss work according to claim 1, wherein some of the longitudinal and transverse members have a generally rectangular cross section and each of the vertical interconnecting members has a generally rectangular cross section.

6. The truss work according to claim 1, wherein the cross sectional area of each or the longitudinal, transverse, and interconnecting members is generally the same.

7. The truss work according to claim 1, wherein the cross sectional area or each of the interconnecting members is different than the cross sectional area of the longitudinal members in the upper grid.

8. The truss work according to claim 1, wherein the cross sectional area of the longitudinal members in the upper grid is different than the cross sectional area of the transverse members in the upper grid.

9. The truss work according to claim 1, wherein the plurality or interconnecting members further includes a plurality of angled members that extend between and interconnect the members in the upper and lower grids.

10. The truss work according to claim 1, wherein the members are all plastic.

* * * * *

UNITED STATES PATENT AND TRADEMARK OFFICE

CERTIFICATE OF CORRECTION

PATENT NO. : 6,993,879 B1
APPLICATION NO. : 10272687
DATED : February 7, 2006
INVENTOR(S) : Richard W. Cantley It is certified that error appears in the above-identified patent and that said Letters Patent is hereby corrected as shown below:

Column 6, line 45 - Replace “members:” with --members;--.

Signed and Sealed this

Twelfth Day of September, 2006

JON W. DUDAS
*Director of the United States Patent and Trademark Office*